United States Patent [19]

Howe

[11] Patent Number: 4,796,413

[45] Date of Patent: Jan. 10, 1989

[54] TREE BALER

[76] Inventor: Wayne Howe, 5330 Tacoma St. NE., Brooks, Oreg. 97305

[21] Appl. No.: 138,570

[22] Filed: Dec. 28, 1987

[51] Int. Cl.[4] ..... B65B 13/20; B65B 63/02

[52] U.S. Cl. ..... 53/530; 414/753

[58] Field of Search ..... 53/530, 576; 100/13; 414/753

[56] References Cited

U.S. PATENT DOCUMENTS

| | | | |
|---|---|---|---|
| 2,856,845 | 10/1958 | Beyette | 100/13 |
| 2,959,412 | 11/1960 | Sjostrom | 414/753 X |
| 3,416,434 | 12/1968 | Woserau | 53/530 X |
| 3,792,857 | 2/1974 | Rubley | 414/753 X |
| 4,270,652 | 6/1981 | Lay | 414/753 X |

*Primary Examiner*—John Sipos

*Attorney, Agent, or Firm*—Richard C. Litman

[57] ABSTRACT

An improved tree baling apparatus. A tree gripping mechanism is attached to a motor driven pulley chain. A horizontal beam of the mechanism has an elongated vertical actuator pivotably attached at an intermediate point on horizontal beam. The beam supports a pair of jaws to penetrated and drag the tree trunk. The jaws are clamped shut by an abutment pressing a first contact on the lower region of the actuator and by a linkage coupled to the horizontal beam and vertical actuator. A second contact on the upper region of the vertical actuator presses another travel limiting abutment to urge the jaws to release the tree by use of the same linkage. A funnel allows the traveling elements to drag a tree through the funnel whereupon the tree branches are compressed together ready for baling.

7 Claims, 3 Drawing Sheets

TREE BALER

BACKGROUND OF INVENTION

1. Field of Invention

The invention relates to a tree baler and more particularly, the invention is directed to an improved gripping mechanism for grasping a tree in a baling process.

The invention further relates to a tree baler that provides means for automatically opening and closing the gripping mechanism.

The method of construction of the device is more fully described herein.

2. Description of the Prior Art

Various prior art gripping mechanisms and the like, as well as the method of their construction in general, are known and are found to be exemplary of the U.S. prior art. They are:

| U.S. Pat. No. | Inventor |
|---|---|
| 2,816,793 | Elberty |
| 3,041,101 | Lebre |
| 3,836,015 | B.J. Travis |
| 4,130,151 | S.O. Ericsson |
| 4,227,854 | W.A. Coffey |

U.S. Pat. No. 2,816,793 discloses grapples that extend to grab and pull an object back. The device comprises a pair of crossed bar members, a jaw member and a means to operate the lever to effect closing movements of the jaw members.

U.S. Pat. No. 3,041,101 discloses clamping tongues for loads. The device includes clamping tongues, a leg for operating the jaws and a carrying means.

The remaining patents discloses various types of gripping devices that may or may not be used in a tree baling process.

These patents or known prior uses teach and disclose various types of gripping mechanisms, as well as methods of their construction; but none of them, whether taken singly or in combination, disclose the specific details of the combination of the invention as to bear upon the claims of the present invention.

SUMMARY OF THE INVENTION

An object, advantage, and feature of the invention is to provide a novel device that is safe and efficient in use, and lends itself to gripping trees in a baling process.

Another object of the invention is directed further to a tree baling device that provides for the automatic opening and closing of its gripping mechanism.

Another object of the invention is directed further to the gripping mechanism of a tree baling device wherein said gripping mechanism includes an upper and lower jaw member for gripping a tree.

Another object of the invention is directed further to the gripping mechanism of a tree baling device wherein said gripping mechanism includes a tension means that keeps the lower jaw member closed relative to the upper jaw member.

Another object of the invention is directed further to the gripping mechanism of a tree baling device wherein said gripping mechanism provides means for adjustably securing said upper jaw member.

These, together with other objects and advantages of the invention reside in the details of the process and the operation thereof, as is more fully hereinafter described and claimed. References are made to drawings forming a part thereof, wherein like numerals refer to like parts throughout.

DESCRIPTION OF THE PREFERRED EMBODIMENT

Figure 1:
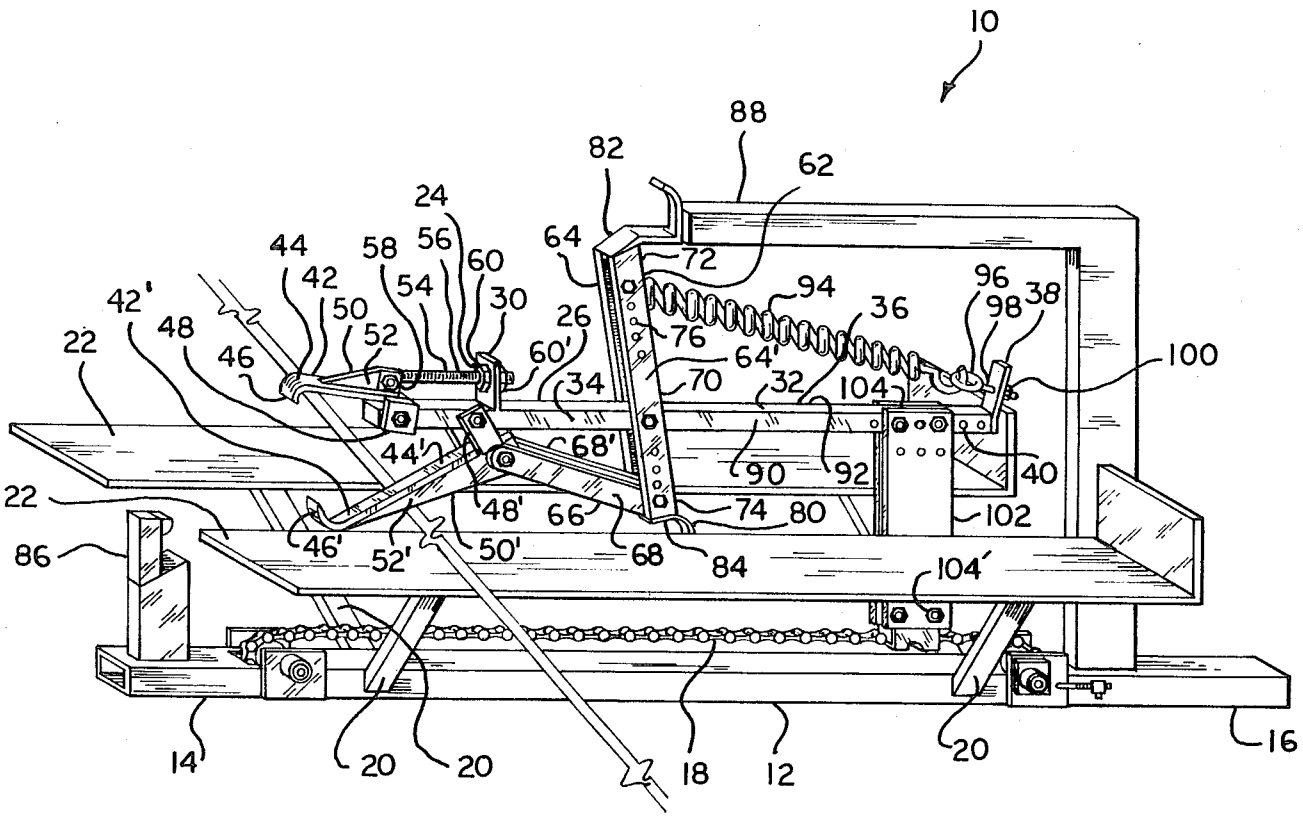
FIG. 1 is a perspective view of the tree baler with its stationary and moving parts without a compressing funnel.
Figure 2:
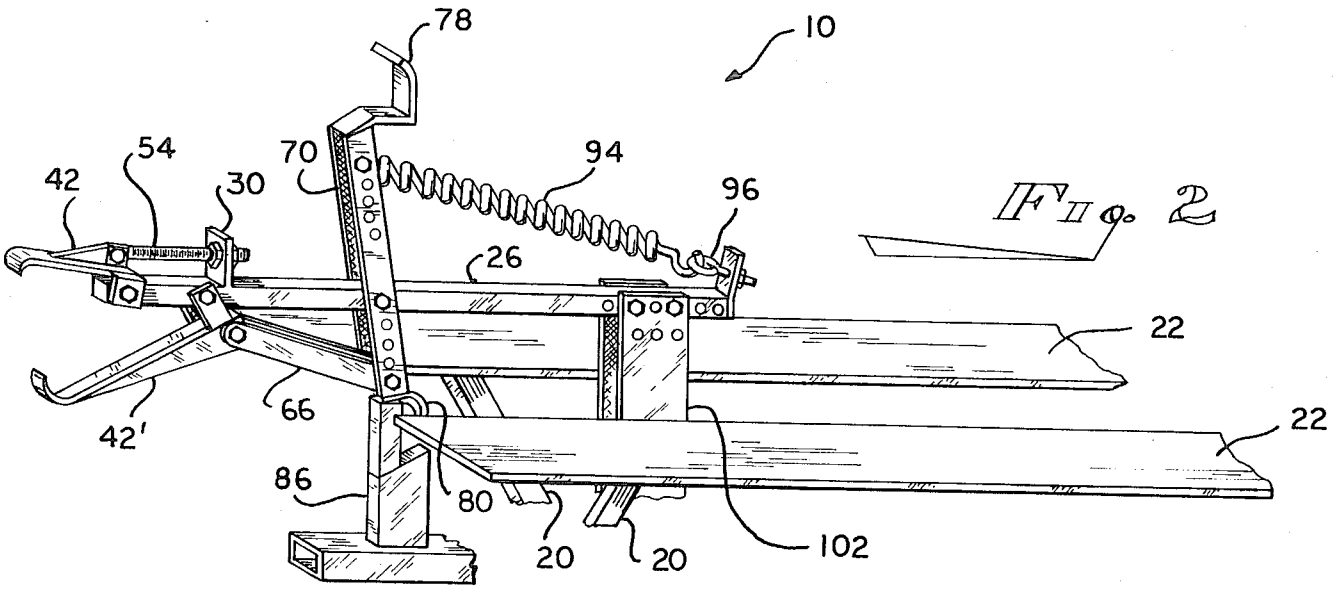
FIG. 2 is a perspective view of the jaws and opening and closing mechanism.
Figure 3:
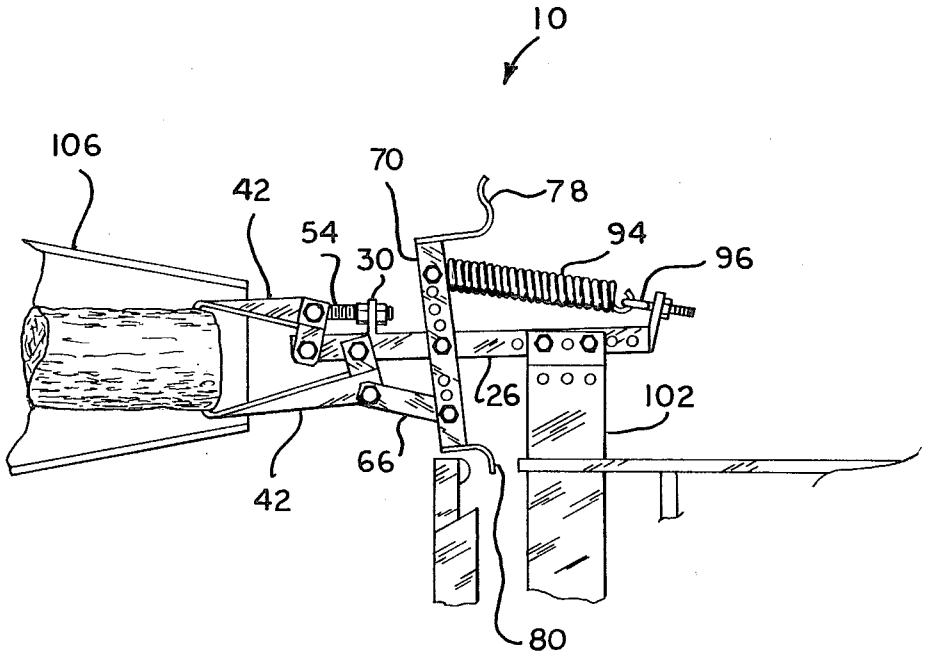
FIG. 3 shows the gripping mechanism with the jaws dragging a tree through a compressing funnel.

Referring now to the drawing FIGS. 1 through 3 illustrate a tree baling apparatus 10 which comprises a horizontally disposed extended travel limiting metal frame 12 having a front 14 and rear section 16, that includes a chain drive 18 capable of forward and backward motion, an electric motor (not shown) that activates the chain drive 18, and a plurality of truss members 20 angularly and oppositely attached thereto along its length. The truss members 20 serve as support means for a pair of horizontally disposed parallel boards 22. Gripping a tree that is to undergo the baling process is accomplished by an improved traveling gripping mechanism 24. The gripping mechanism 24 includes a horizontally disposed beam 26 having a forward section 28 with an extension 30 attached to its top surface 32, an intermediate or mid-section 34, and a aft section 36 that includes an adjunct 38 angularly attached to its end and a plurality of holes 40 which provides a means to longitudinally adjust the beam 26; upper and lower jaw members 42 and 42' that include levers 44 and 44' having a hook 46 and 46' at one end, clasps 48 and 48' at the other, and an incline 50 and 50' integral with its back 52 and 52'. The jaw members are pivotally attached to the forward section 28 of the beam 26 via the clasps 48 and 48'; the upper jaw member 42 being forward of the lower jaw member 42'. A first coupling 54 having means for adjustment, such as a partially threaded bolt 56 having one flat end 58 and a pair of nuts 60 and 60' serve to secure the upper jaw member 42 in a desired position. The flat end 58 of the bolt 56 is pivotally connected to the incline 50 of the upper jaw member while the nut 60 provides upper limiting means for the coupler. The bolt 56 is disposed within the extension 30 until the upper limiting means contacts the extension 30. The other nut 60' disposed about the extending portion of the bolt 56 to provides lower limiting means for the first coupling 54. When grasping a tree, only movement of the lower jaw member 42' occurs. This movement is caused by a traveling actuator 62, such as a pair of virtually, vertically disposed parallel rafters 64 and 64' and a linkage 66 such as a pair of metal strips 68 and 68'. The rafters 64 and 64' has an intermediate or mid-region 70 and an upper and lower region 72 and 74 that includes a plurality of openings 76 which serve as a means for adjustment. The linkage 66 is pivotally connected between both the incline 50' of the lower jaw member 42' and to the lower region 74 of the actuator 62. A first and second contact member 78 and 80 welded to the top 82 and bottom 84 of the actuator 62 that serve to communicate with a first bumper 86 attached to the front 14 of the frame 12 and a second bumper 88 attached the rear 16 of the frame respectively. The actuator 62 is pivotally attached at its mid-region 70 to the face 90 and back 92 of the beam 26 at its center. A spring 94 attached to the upper region 72 of the actuator 62 at one end and to an attachment means 96 secured within the adjunct 38 of the beam 26 serves to provide tension and thereby retain the lower jaw member 42' in a closed position relative to the upper jaw member 42. The attachment means 96 includes a threaded eye bolt 98 secured within the adjunct 38 by a nut 100. The gripping mechanism 24 is connected to the chain drive 18 by a connecting means 102 such as a pair of vertically disposed elongated plates 104 and 104'. Means for compressing the branches of a tree to be baled is accomplished by a tapered funnel 106. The funnel 106 is attached to the front 14 of the frame 12 between the boards 22.

To operate the invention, the drive mechanism 18 is activated to move in a forward direction until the jaw members enters the funnel 106 and the second contact member 80 engages and abuts the second bumper 88 of the frame thereby overriding the spring's tension. Upon overriding the springs tension the actuator 62 is displaced and the lower jaw member 42' descends. At this point the tree is placed within the jaw members and the drive mechanism 18 is reversed thereby allowing the spring 94 to displace the actuator 62 and in turn cause the lower jaw member 42' to quickly ascend and clamp the tree between the two jaw members 42 and 42''. As drive mechanism continues to move in the reverse direction the tree is pulled through the funnel 106 where its branches are compressed. Upon exiting the funnel 106 the tree is then wrapped by a suitable wrapping means (not shown). The drive mechanism 18 continues in the reverse direction until the first contact member 78 engages and abuts the first bumper 88. This engagement again displaces the actuator 62 and causes the lower jaw member 42' to descend. At this point, the tree is removed and the process is resumed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. A tree baling apparatus for attachment to a motor driven pulley chain comprising; traveling jaw means having both an open and a closed position for clamping on a tree when pressed toward said closed position and releasing the tree when urged toward said open position; means for reciprocating said jaw means along a path; traveling upper contact means and traveling lower contact means for opening said jaw means; stationary limiting means fixed to said tree baling apparatus for abutment to said upper and lower contact means at the ends of said path; a traveling horizontally disposed beam connected to said reciprocating means and having a forward section, an intermediate section, and an aft section with said jaw means mounted on said first forward section; a traveling vertical actuator having an upper region, an intermediate region and lower region pivotally attached to said intermediate section of the horizontally disposed beam at the intermediate region of actuator; said upper contact means and said lower contact means being on the upper region and lower region of said vertical actuator; and linkage means connecting said jaw means and said actuator for driving said jaw means toward said open position by said actuator being pushed by said abutment on said upper and lower contact means and means connected to said actuator and linkage means for closing said jaw means when said contact and limiting means are out of abutment.

2. The tree baling apparatus of claim 1 wherein, said means for closing said jaw means comprising biasing means to urge the actuator to pivot toward the orientation that closes said jaws.

3. The tree baling apparatus of claim 2 wherein, said biasing means comprises a tension spring that urges the upper region of said actuator away from said jaws.

4. The tree baling apparatus of claim 1 wherein; said traveling jaw means comprises an upper and a lower jaw with one said jaw being adjustably oriented by a screw thread.

5. The tree baling apparatus of claim 1 further comprising; two parallel boards, spaced from each other to allow the traveling beam, jaws and actuator to move therebetween.

6. The tree baling apparatus of claim 4 with said adjustably oriented jaw being otherwise fixed in its angular position.

7. The tree baling apparatus of claim 1 further comprises a funnel means forward of said forward section for compressing said tree branches whereby the tree is ready for baling.

* * * * *